US006077143A

United States Patent [19]

Gutierrez

[11] Patent Number: 6,077,143

[45] Date of Patent: Jun. 20, 2000

[54] BUBBLE BLOWER

[76] Inventor: Andrez Gutierrez, 14831 Kittridge St., Van Nuys, Calif. 91405

[21] Appl. No.: 09/304,685

[22] Filed: May 4, 1999

[51] Int. Cl.[7] ..... A63H 33/28; A63H 33/40

[52] U.S. Cl. ..... 446/16; 446/15; 446/178

[58] Field of Search ..... 446/15, 16

[56] References Cited

U.S. PATENT DOCUMENTS

| | | | |
|---|---|---|---|
| 2,412,732 | 12/1946 | Holman | 446/16 |
| 2,452,794 | 11/1948 | Saachy | 446/15 |
| 2,862,320 | 12/1958 | Mayo | 446/16 |
| 3,708,909 | 1/1973 | Winston | 446/16 |
| 3,736,694 | 6/1973 | Lebensfeld | 446/15 |
| 4,044,496 | 8/1977 | Jernstrom . | |
| 4,447,982 | 5/1984 | Gushea . | |
| 5,269,715 | 12/1993 | Silveria et al. | 446/15 |
| 5,542,869 | 8/1996 | Petty | 446/15 |

*Primary Examiner*—Robert A. Hafer
*Assistant Examiner*—K. Hughes
*Attorney, Agent, or Firm*—William W. Haefliger

[57] ABSTRACT

A bubble producing device comprising a rotor defining an axis that extends longitudinally, the rotor defining a plurality of through openings spaced about an axis to dip into a bubble solution bath, and to rise above the bath as the rotor rotates; a motor driven fan directed to displace air toward openings above the bath; and a circular series of turbine vanes carried by the rotor and angled to receive air displaced by the fan, for creating torque acting to rotate the rotor.

15 Claims, 4 Drawing Sheets

BUBBLE BLOWER

BACKGROUND OF THE INVENTION

This invention relates generally to a device for efficiently producing a stream of bubbles for entertainment or as an advertisement tool for businesses or store fronts, and more specifically to an air driven rotor that produces such bubbles.

For many years streams of bubbles have fascinated children and adults alike. There have been many different devices on the market that produce bubbles, most requiring some kind of participation such as dipping a loop or wand into a bubble forming solution and then swinging the loop through the air to produce bubbles. Other such devices are either too complex and costly, or they are relatively dependent on natural wind to produce bubbles.

An example of a bubble producing device is that set forth in U.S. Pat. No. 5,269,715 that produces bubbles by means of turning a hand crank, and which produces a mixture of air water and bubble mixture so as to produce bubbles.

Another example is U.S. Pat. No. 2,412,732 wherein an electric fan of no specified voltage exerts a non specific stream of air onto a number of separate dippers mounted to dip into bubble solution.

A bubble blowing apparatus is also shown in U.S. Pat. No. 5,542,869 wherein a fan assembly has its motivating force provided by a breeze of light natural winds which are not always available due to constant changes in weather.

SUMMARY OF THE INVENTION

The present invention is not dependent on natural winds, and provides a novel and improved construction and operation of a bubble blowing device. The present invention also does not require manual turning or cranking to cause the formation of bubbles; its motivating force being provided by an electric fan and battery, or low voltage transformer.

It is a major object of the invention to provide an improved bubble forming and blowing apparatus that comprises:

a) a rotor defining an axis that extends longitudinally, b) the rotor defining a plurality of through openings spaced about said axis to dip into a bubble solution bath, and to rise above the bath as the rotor rotates, c) a motor driven fan directed to displace air toward such openings above the bath, and d) a circular series of turbine vanes carried by the rotor and angled to receive air displaced by the fan, for creating torque acting to rotate the rotor.

Another object is to provide through openings arrayed in a circular succession about said axis, so that successive openings are closely spaced apart.

Yet another object is to provide turbine vanes that extend outwardly relative to the axis, and toward the circular succession of openings.

An additional object is to provide a trough or tray for the bubble solution located below said axis, so that the through openings dip to proper depth into said bath, and means supporting the rotor for rotation, to carry the openings above the bath. As will be seen, solution level control means controls the surface level of the bath, relative to the rotor, so that only the lowermost openings dip into the bath. In this way, solution never spills from the trough or tray, as during operation, to create a hazard or pond, and solution is conserved.

A further object comprises provision of vanes with structure that defines the structure forming the bubble forming openings, to be loop shaped, such loops facing generally longitudinally toward oncoming air displaced by the fan.

An additional object is the provision of means to control the height of the trough above a support surface. Such height control means may comprise a group of adjustable legs on which the trough is supported. The rotor loops and vanes may comprise molded plastic material, as well as the trough and legs.

These and other objects and advantages of the invention, as well as the details of an illustrative embodiment, will be more fully understood from the following specification and drawings, in which:

DRAWING DESCRIPTION

Figure 1:
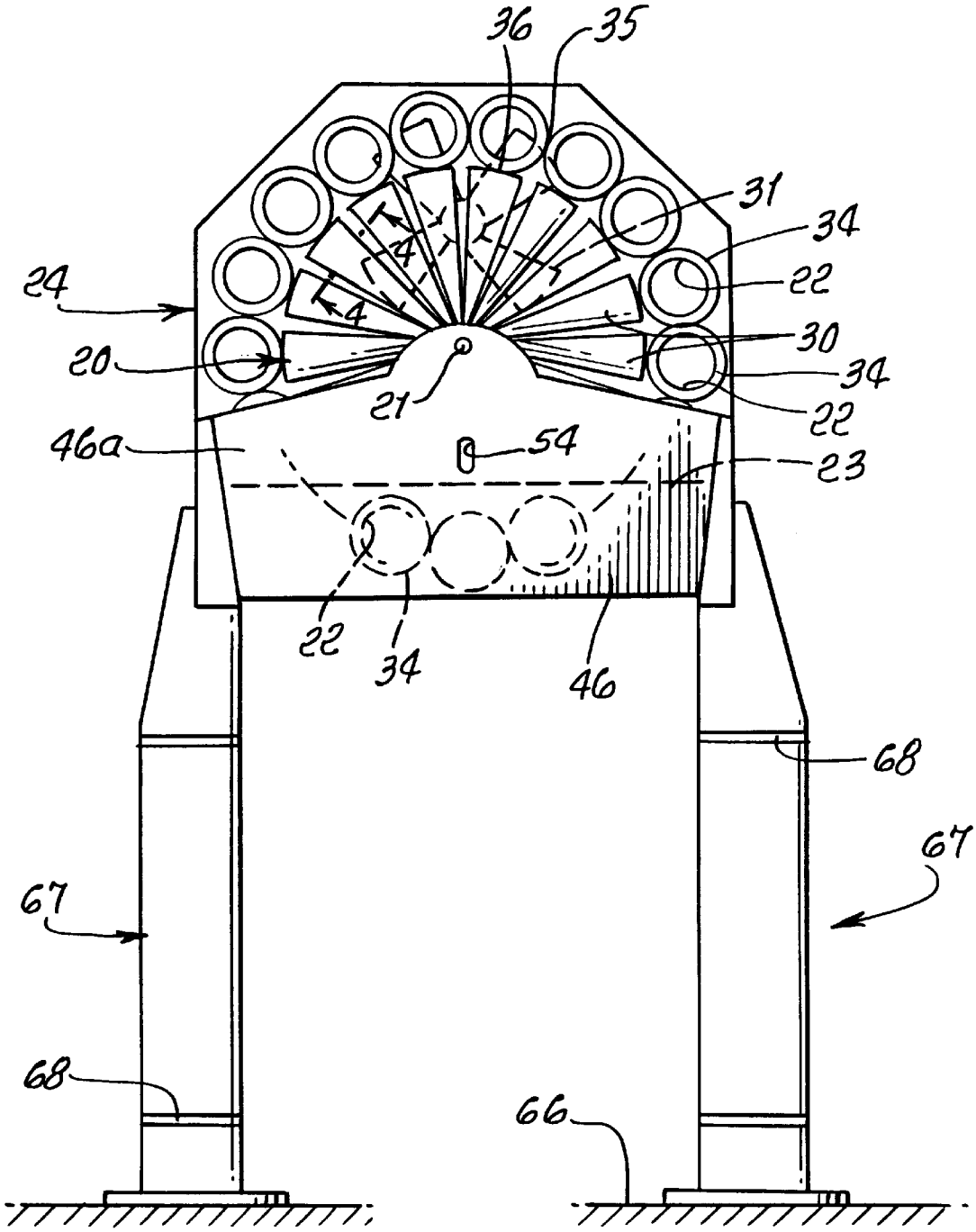
FIG. 1 is a frontal view of apparatus incorporating the invention.
Figure 3:
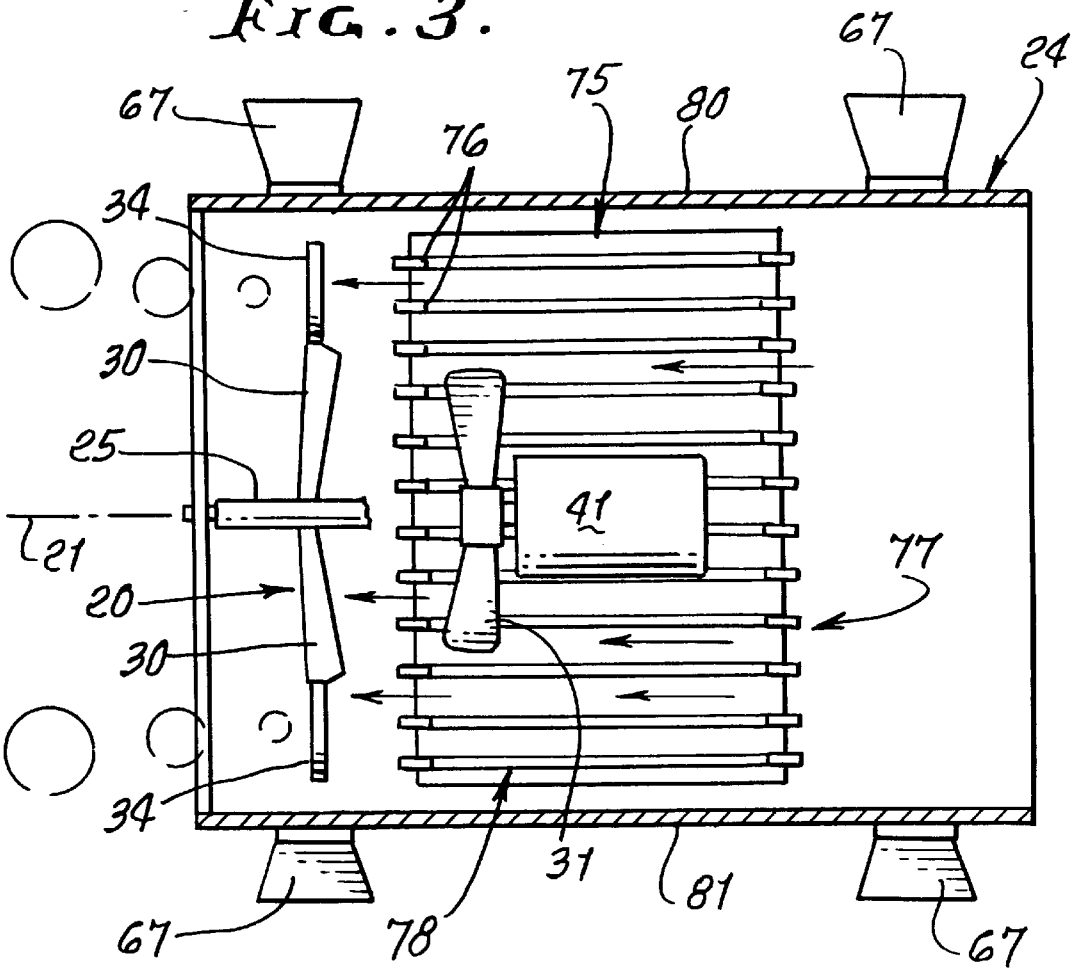
FIG. 3 is a top plan view of the FIG. 1 apparatus.
Figure 3A:
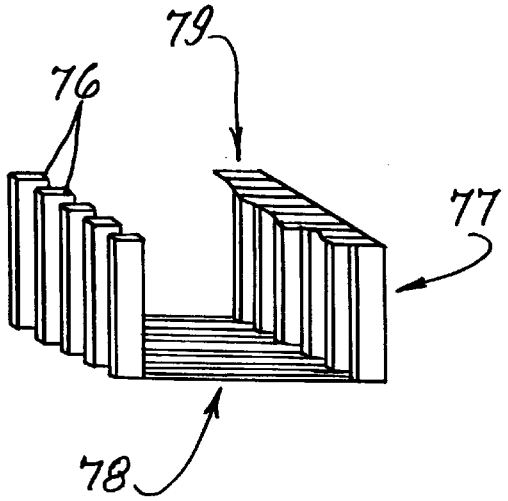
Figure 4:
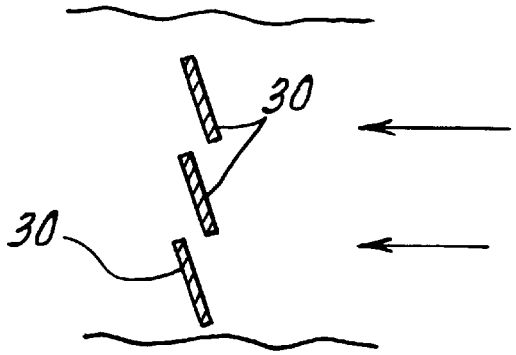
Figure 5:
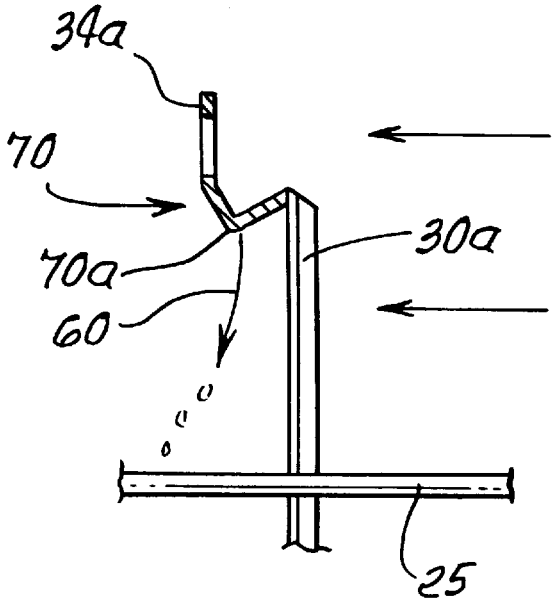

FIG. 3*a* is a perspective view of protective grid structure, for the motor and fan, FIG. 4 is a section taken on lines 4—4 of FIG. 1;

FIG. 5 is a fragmentary section showing a modification; and

Figure 6:
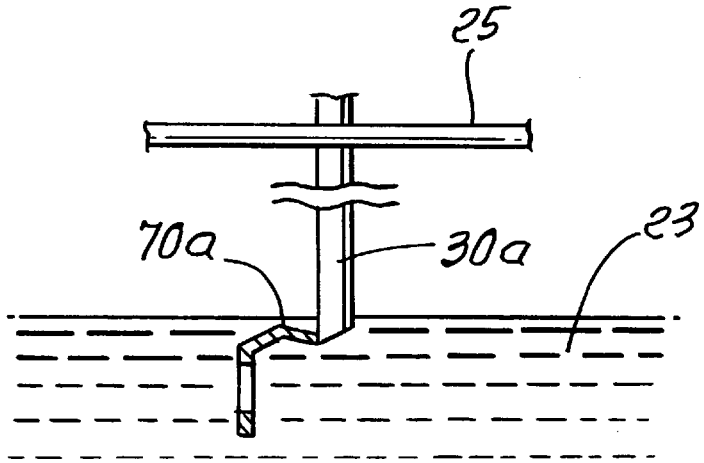

FIG. 6 is another view of the FIG. 5 modification.

DETAILED DESCRIPTION

In FIGS. 1–4, a rotor 20 defines an axis 21 that extends horizontally. The rotor defines a plurality of through openings 22 spaced about axis 21, to successively dip into bubble solution in a bath 23 received in a trough or tray 24, as the rotor rotates about axis 21. A rotor axle 25 has opposite ends at 26 and 27 that are bearing supported by trough carried wall structure defining bearings, at 28 and 29.

Figure 2:
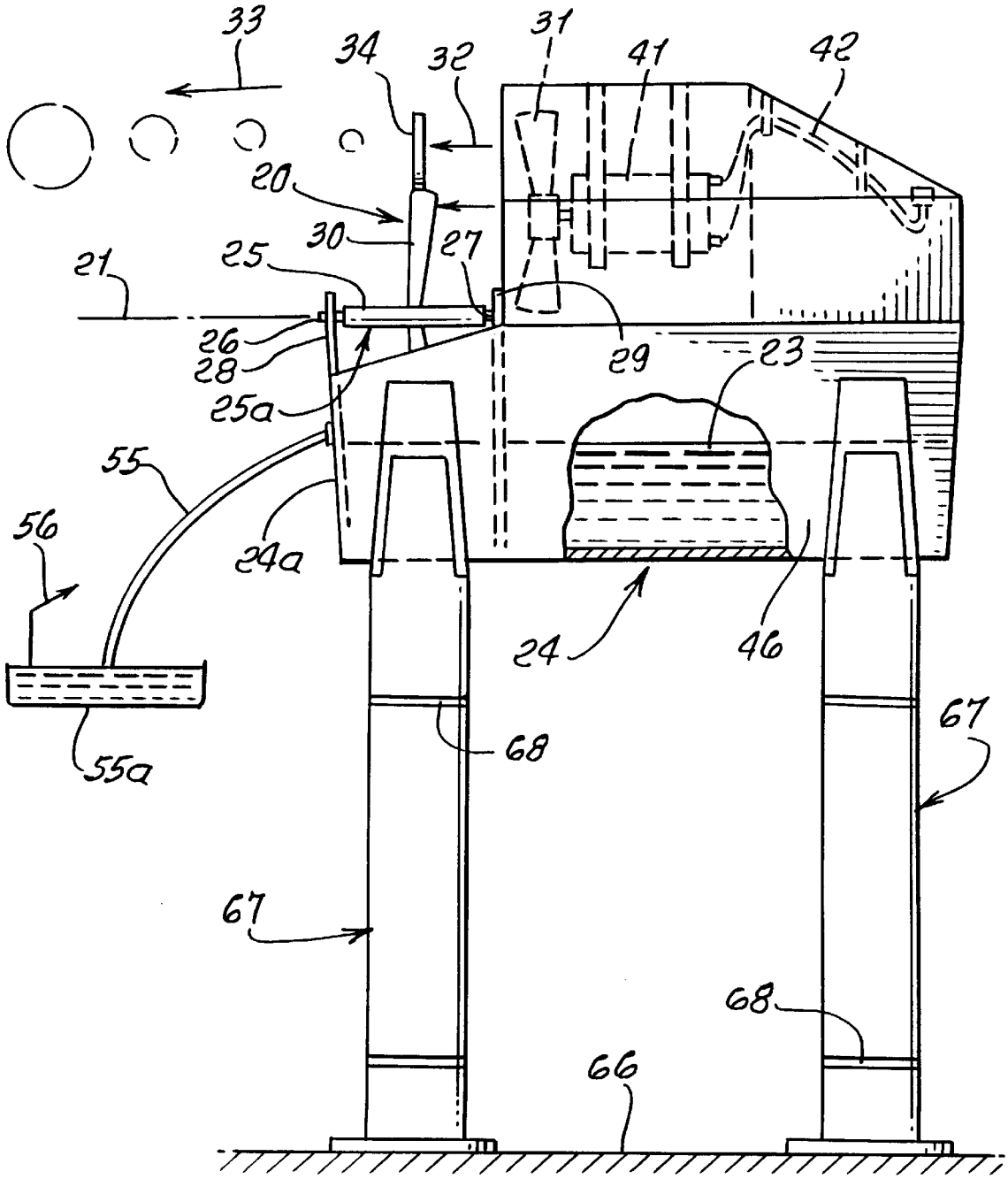
FIG. 2 is a left side elevation view of the FIG. 1 apparatus.

The rotor also includes a circular series of turbine vanes 30, angled to receive air displaced by a fan 31 blowing air in direction 32 toward the rotating vanes and toward the openings. Such air flow causes the rotor to rotate, so that films of bubble solution are formed at and across the openings 22 during dipping into the solution in bath 23, whereby bubbles form and are blown at 33 forwardly and away from the rotor. Trough front wall 28 intercepts any bubbles blown forwardly of the openings in the rotor lowermost portion. As seen in FIG. 2, the vanes diverge outwardly toward the openings, and are integral with narrow structural rings 34 that form the openings. For rigidity and simplicity, the rings may be peripherally joined at 35, and the vanes joined at their rotor edges to peripheries of the rings, as at 36. Joindure location 35 may be at 3 and 9 o'clock positions, and jointure locations 36 may be located at 6 o'clock, with respect to each ring 34. This facilitates one-piece plastic molding of the vanes and rings, as well as maximum bubble formation per each rotation of the rotor, and maximum torque development at the rotor in response to air displacement against the vanes and rings. See arrows 32 in FIG. 2. The rings may be somewhat circularly spaced from one another as an alternate option.

The fan 31 is located close to the rotor as shown in FIG. 2, with an electric motor 41 driving the fan. Wiring appears at 42. FIG. 4 shows angling of the vanes to pass air to develop torque. Each vane may be radially associated with a ring or loop 34. The rotor hub 25*a* is associated with the axle 25. The blades may be angled to cause rotation in either direction.

A trough 46 is provided for the solution bath located below axis 21, so that the through openings 22 defined by rings or loops 34 dip at most efficient level into the solution, as they rotate. Solution or bath surface level control means is provided, so that only the lowermost openings 22 dip into the bath, as seen in FIG. 1. Such control means is shown in the form of an opening 54 in the side wall 46*a* of the trough. A drain line 55 may return the surplus to a source 55*a*, and liquid from that source may be supplied as at 56 to the bath where 56 indicates a flow means to return liquid from source 55*a* to the bath.

FIGS. 5 and 6 show an alternate form of the ring of loops 34*a*, and the vanes 30*a*. The loops are axially offset relative to the vanes, and the vane tips joined to the loops, as by drain structure 70. That intermediate structure tends to receive excess liquid drainage off the loops, and to drain it into the bath at drain paths 60 offset from the vanes, whereby less solution is blown off the vanes, and the vanes carry less liquid film, so that more efficient operation is enabled, especially when the vanes are closely spaced, as shown. Drain structure may define a lower drainage edge 70*a* off which drained liquid drops, by gravity, as seen in FIG. 5. FIG. 6 shows the lowermost loops dipping into bath 23.

Means is also provided to control the height of the trough, above a support surface 66. Such means may comprise legs 67, which are adjustable as at 68, for such height control. The bubbles are thereby elevated from the support surface such as a table, and their later collapse is away from the table so that solution does not collect on the table.

FIGS. 3 and 3*a* also show protective grid structure 75 for the motor and fan. It includes forwardly directed, laterally spaced, vertically extending louvers 76 forwardly of the fan to pass and direct air flow to the rotor 20, an upright, laterally extending grid 77 rearwardly of the motor, and a bottom grid 78 extending horizontally beneath the motor and fan. A top grid 79 may also be provided as indicated.

Housing upright side walls appear at 80 and 81. This structure protects against a user's fingers coming in contact with the motor and rotating fan, while enabling motor and fan operations to produce bubbles.

I claim:

1. In a bubble producing device, the combination comprising:

a) a rotor defining an axis that extends longitudinally, b) said rotor defining a plurality of through openings spaced about said axis to dip into a bubble solution bath, and to rise above said bath as the rotor rotates, c) a motor driven fan directed to displace air toward said openings above the bath, d) a circular series of turbine vanes carried by the rotor and angled to receive air displaced by the fan, for creating torque acting to rotate the rotor, e) said through openings being defined by a rotor outer structure that is substantially offset along the rotor axis from a radial plane that contains the vanes, so that a drain structure is provided to draw excess bath liquid off said rotor outer structure, in spaced relation to the vanes, f) and said drain structure being located between inner portions of said rotor outer structure, and outer portions of said vanes, and bridges the offset therebetween.

2. The combination of claim 1 wherein said through openings are arrayed in a circular succession about said axis, so that successive openings are closely spaced apart.

3. The combination of claim 2 wherein said turbine vanes extend outwardly relative to said axis, and toward said circular succession of openings.

4. The combination of claim 1 including a trough for said solution located below said axis, so that said through openings dip into said bath, and means supporting the rotor for rotation, to carry said openings above the bath.

5. The combination of claim 4 including level control means to control the surface level of the bath, relative to the rotor so that only the lowermost openings dip into the bath.

6. The combination of claim 5 wherein said level control means comprises an outlet from the trough for allowing escape of bath solution as the surface level thereof rises to the level of said outlet.

7. The combination of claim 1 wherein the outermost extents of said vanes have structure attached thereto forming said openings.

8. The combination of claim 7 wherein said structure forms loops facing generally longitudinally.

9. The combination of claim 6 wherein said rotor has a hub located above the level of said outlet.

10. The combination of claim 4 including means to control the height of said trough above a support surface.

11. The combination of claim 10 wherein said height control means comprises a group of legs on which the trough is supported.

12. The combination of claim 1 wherein said rotor and vanes comprise molded plastic material, said openings formed by rings, the vanes joined to the rings at ring locations closest to said axis, and successive rings joined together at other locations.

13. The combination of claim 4 wherein said motor driven fan is carried by said trough.

14. The combination of claim 1 including protective grid structure protectively spaced from said motor driven fan.

15. The combination of claim 14 wherein said grid structure includes louvers to pass and direct air flow from the fan toward the rotor, and grid elements rearwardly of the motor.

* * * * *